US010458418B2

(12) United States Patent
Yamamoto et al.

(10) Patent No.: US 10,458,418 B2
(45) Date of Patent: Oct. 29, 2019

(54) CEILING FAN

(71) Applicants: PANASONIC ECOLOGY SYSTEMS CO., LTD., Aichi (JP); PANASONIC MANUFACTURING MALAYSIA BERHAD, Shah Alam, Selangor Darul Ehsan (MY)

(72) Inventors: Kiminobu Yamamoto, Kuala Lumpur (MY); Kee Cheng Ng, Selangor (MY); Wei Ming Tan, Selangor (MY); Hiroyuki Kuramochi, Aichi (JP)

(73) Assignee: PANASONIC ECOLOGY SYSTEMS CO., LTD., Aichi (JP)

( * ) Notice: Subject to any disclaimer, the term of this patent is extended or adjusted under 35 U.S.C. 154(b) by 487 days.

(21) Appl. No.: 15/129,477

(22) PCT Filed: Jan. 7, 2015

(86) PCT No.: PCT/JP2015/000038
§ 371 (c)(1),
(2) Date: Sep. 27, 2016

(87) PCT Pub. No.: WO2015/145918
PCT Pub. Date: Oct. 1, 2015

(65) Prior Publication Data

US 2017/0101998 A1 Apr. 13, 2017

(30) Foreign Application Priority Data

Mar. 28, 2014 (JP) ..... 2014-069854

(51) Int. Cl.
*F04D 25/08* (2006.01)
*F04D 29/60* (2006.01)
(Continued)

(52) U.S. Cl.
CPC ..... *F04D 25/088* (2013.01); *F04D 29/023* (2013.01); *F04D 29/601* (2013.01); *F04D 29/646* (2013.01)

(58) Field of Classification Search
CPC .... F04D 25/088; F04D 29/023; F04D 29/601; F04D 29/646
See application file for complete search history.

(56) References Cited

U.S. PATENT DOCUMENTS 7,785,077 B2 * 8/2010 Richardson ..... F04D 29/601 416/244 R
2006/0138295 A1 * 6/2006 Blateri ..... F04D 25/088 248/343

(Continued)

FOREIGN PATENT DOCUMENTS

JP 2009-209753 A 9/2009
JP 2009-228622 A 10/2009

(Continued)

OTHER PUBLICATIONS

International Preliminary Report on Patentability issued in Application No. PCT/JP2015/000038 dated Oct. 13, 2016.

(Continued)

*Primary Examiner* — Woody A Lee, Jr.
*Assistant Examiner* — Sabbir Hasan
(74) *Attorney, Agent, or Firm* — McDermott Will & Emery LLP

(57) ABSTRACT

The ceiling fan includes: a body having a plurality of blades and an upper mounting pipe portion; a suspender which is fixed to a ceiling; a first pipe which is suspended from the suspender and suspends the body by the upper mounting pipe portion; and a second pipe which is accommodated in the inside of a lower portion of the first pipe and into which an upper portion of the upper mounting pipe portion is inserted. The first pipe, the second pipe and the upper (Continued)

mounting pipe portion are connected to each other by a connecting bolt which penetrates an overlapping part where the first pipe, the second pipe and the upper mounting pipe portion overlap with each other. A hollow projecting portion which projects from an outer peripheral surface of the second pipe is engaged with a recessed portion formed on an edge of a lower opening of the first pipe and a protruding portion formed on an outer peripheral surface of the upper mounting pipe portion thus restricting at least the relative movement among the first pipe, the second pipe, and the upper mounting pipe portion in the rotating direction of the blades.

8 Claims, 10 Drawing Sheets

(51) Int. Cl.
*F04D 29/02* (2006.01)
*F04D 29/64* (2006.01)

(56) References Cited

U.S. PATENT DOCUMENTS

| | | | | |
|---|---|---|---|---|
| 2008/0286111 | A1 | 11/2008 | Richardson et al. | |
| 2011/0002783 | A1 | 1/2011 | Yamamoto et al. | |
| 2013/0136603 | A1* | 5/2013 | Kuramochi ..... | F04D 25/088 416/170 R |

FOREIGN PATENT DOCUMENTS

| | | | |
|---|---|---|---|
| JP | 2012-117545 | A | 6/2012 |
| WO | 2012/032755 | A1 | 3/2012 |

OTHER PUBLICATIONS

International Search Report issued in Application No. PCT/JP2015/000038 dated Apr. 7, 2015, with English translation.

* cited by examiner

CEILING FAN

RELATED APPLICATIONS

This application is the U.S. National Phase under 35 U.S.C. § 371 of International Application No. PCT/JP2015/000038, filed on Jan. 7, 2015, which in turn claims the benefit of Japanese Application No. 2014-069854, filed on Mar. 28, 2014, the disclosures of which are incorporated by reference herein.

TECHNICAL FIELD

The present invention relates to a ceiling fan.

BACKGROUND ART

As a conventional ceiling fan, there has been known a ceiling fan which includes: a suspender which is fixed to a ceiling; a pipe having a cylindrical shape which is suspended by the suspender; and a body which includes a plurality of rotatable blades suspended from the pipe (see Patent Document 1, for example). The pipe includes: a first pipe having a cylindrical shape which is suspended from the suspender; a second pipe which is accommodated in the inside of a lower portion of the first pipe; and an upper mounting pipe portion which extends upward from the body and is inserted into the inside of the second pipe. In a state where the second pipe and the upper mounting pipe portion are inserted into the inside of the first pipe, the respective pipe bodies are connected to each other using a connecting bolt which penetrates an overlapping part where the first pipe, the second pipe and the upper mounting pipe portion overlap with each other.

CONVENTIONAL ART DOCUMENT

Patent Document

Patent Document 1: JP 2009-209753.A

SUMMARY OF THE INVENTION

Problems to be Solved by the Invention

Such a conventional ceiling fan has a drawback that an abnormal wear occurs in the connecting portion of the pipe bodies.

That is, the body having the plurality of blades is mounted on the ceiling fan at an installation site and hence, depending on an installation site, there are some cases where a force is applied to the blades due to an external load at the time of mounting the blades or cleaning the blades so that the blades are deformed and are brought into an unstable state. When the ceiling fan is driven in such a state, there are some cases where a force which tends to generate large swinging of the body is generated. Through holes through which a connecting bolt passes are formed in a connecting portion where the pipe bodies are connected to each other, that is, an overlapping part where the first pipe, the second pipe and the upper mounting pipe portion overlap with each other. However, the conventional ceiling fan adopts the constitution where one connecting bolt penetrates a plurality of through holes (six through holes in this case) and hence, gaps are necessary between the connecting bolt and the respective through holes by taking into account the penetration operability of the connecting bolt. Accordingly, when a force which tends to generate large swinging of the body is generated, rattling is liable to be generated in the rotation direction of the blades at the connecting portion where the first pipe, the second pipe and the upper mounting pipe portion are connected to each other. When such rattling is large, the body largely swings so that the relative movement between the members is generated whereby an abnormal wear occurs in the connecting portion thus giving rise to a possibility that the body drops.

Accordingly, it is an object of the present invention to provide a ceiling fan where it is possible to suppress the occurrence of an abnormal wear at a connecting portion where pipe bodies for suspending a body of the ceiling fan are connected to each other.

Means for Solving the Problems

In order to achieve the object, a ceiling fan according to one aspect of the present invention includes a body having a plurality of blades which are rotatable about a center of rotation, and an upper mounting pipe portion which extends upward along the center of rotation as a center axis thereof, a suspender fixed to a ceiling, a first pipe which is suspended from the suspender along the center of rotation of the blades as a center axis thereof, and suspends the body by the upper mounting pipe portion, and a second pipe which is accommodated in the inside of a lower portion of the first pipe and into which an upper portion of the upper mounting pipe portion is inserted. The first pipe, the second pipe and the upper mounting pipe portion are connected to each other by a connecting bolt and a nut. The connecting bolt penetrates an overlapping part where the first pipe, the second pipe and the upper mounting pipe portion overlap with each other in the direction intersecting with the center axis. The nut is threadedly engaged with the connecting bolt. The second pipe has a hollow projecting portion having a cylindrical shape or a partial cylindrical shape which projects from an outer peripheral surface of the second pipe in the direction intersecting with the center axis. A recessed portion which is brought into contact with or is arranged close to an outer peripheral surface of the hollow projecting portion of the second pipe is provided on an edge of a lower opening of the first pipe. A protruding portion which is brought into contact with or is arranged close to an inner peripheral surface of the hollow projecting portion of the second pipe is provided on an outer peripheral surface of the upper mounting pipe portion. At least the relative movement among the first pipe, the second pipe, and the upper mounting pipe portion in the rotating direction of the blades is restricted by the hollow projecting portion of the second pipe.

Effects of the Invention

According to the present invention, it is possible to suppress the occurrence of an abnormal wear at a connecting portion where pipe bodies for suspending a body of the ceiling fan are connected to each other.

MODES FOR CARRYING OUT THE INVENTION

Figure 1:
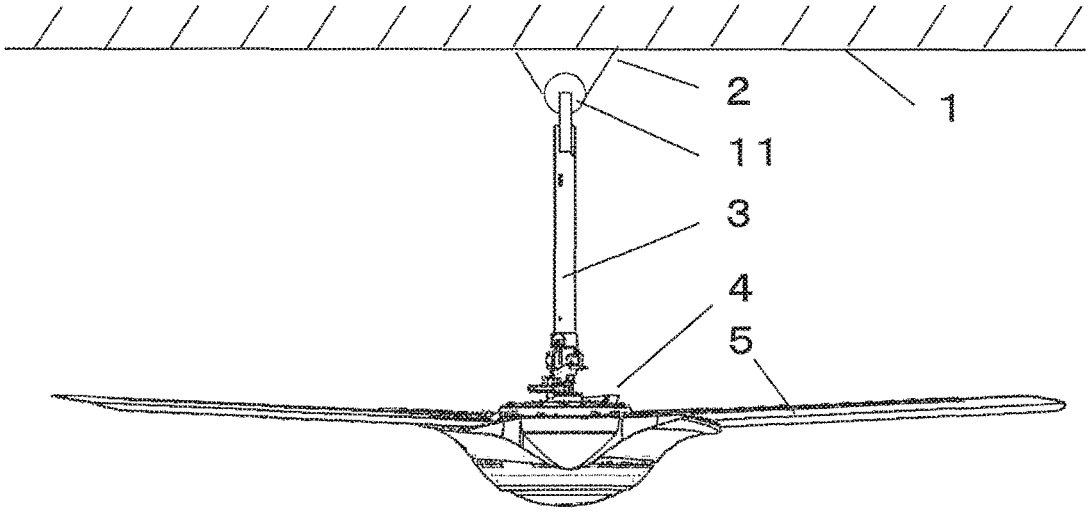
FIG. 1 is an overall view showing the schematic constitution of a ceiling fan according to an embodiment 1 of the present invention.

A ceiling fan according to a first aspect of the present invention includes a body having a plurality of blades which are rotatable about a center of rotation, and an upper mounting pipe portion which extends upward along the center of rotation as a center axis thereof, a suspender fixed to a ceiling, a first pipe which is suspended from the suspender along the center of rotation of the blades as a center axis thereof, and suspends the body by the upper mounting pipe portion, and a second pipe which is accommodated in the inside of a lower portion of the first pipe and into which an upper portion of the upper mounting pipe portion is inserted. The first pipe, the second pipe and the upper mounting pipe portion are connected to each other by a connecting bolt and a nut. The connecting bolt penetrates an overlapping part where the first pipe, the second pipe and the upper mounting pipe portion overlap with each other in the direction intersecting with the center axis. The nut is threadedly engaged with the connecting bolt. The second pipe has a hollow projecting portion having a cylindrical shape or a partial cylindrical shape which projects from an outer peripheral surface of the second pipe in the direction intersecting with the center axis. A recessed portion which is brought into contact with or is arranged close to an outer peripheral surface of the hollow projecting portion of the second pipe is provided on an edge of a lower opening of the first pipe. A protruding portion which is brought into contact with or is arranged close to an inner peripheral surface of the hollow projecting portion of the second pipe is provided on an outer peripheral surface of the upper mounting pipe portion. At least the relative movement among the first pipe, the second pipe, and the upper mounting pipe portion in the rotating direction of the blades is restricted by the hollow projecting portion of the second pipe.

A second aspect of the present invention provides the ceiling fan according to the first aspect of the present invention, in which a first slot which extends upward from the recessed portion is formed on the first pipe.

A third aspect of the present invention provides the ceiling fan according to the second aspect of the present invention, in which an upper projecting portion which extends upward from an upper portion of the hollow projecting portion and is positioned inside the first slot formed in the first pipe is further formed on the second pipe, and at least the relative movement between the first pipe and the second pipe in the rotating direction of the blades is restricted by the upper projecting portion of the second pipe.

A fourth aspect of the present invention provides the ceiling fan according to any one of the first aspect to the third aspect, in which a rib which projects outward from the outer peripheral surface of the second pipe is formed on the second pipe, a distal end of the rib is brought into contact with an inner peripheral surface of the first pipe, and a material of the second pipe is nylon.

A fifth aspect of the present invention provides the ceiling fan according to any one of the first aspect to the fourth aspect, in which the recessed portion formed on the first pipe is positioned at a height position below the connecting bolt.

A sixth aspect of the present invention provides the ceiling fan according to any one of the first aspect to the fifth aspect, in which a gap formed between the first pipe and the second pipe is smaller than a gap formed between the second pipe and the upper mounting pipe portion.

A seventh aspect of the present invention provides the ceiling fan according to any one of the first aspect to the sixth aspect, in which a contact length between an inner peripheral surface of the hollow projecting portion of the second pipe and the projecting portion of the upper mounting pipe portion is larger than a contact length between the outer peripheral surface of the hollow projecting portion and the recessed portion of the first pipe, in the projecting direction of the hollow projecting portion.

An eighth aspect of the present invention provides the ceiling fan according to any one of the first aspect to the seventh aspect, in which the projecting portion is a bolt mounted on an outer peripheral surface of the second pipe, and an outer peripheral surface of the bolt is brought into contact with or is arranged close to an inner peripheral surface of the hollow projecting portion of the second pipe.

Hereinafter, embodiments of the present invention are explained by reference to drawings. The present invention is not limited by the embodiments.

Embodiment 1

Figure 2:
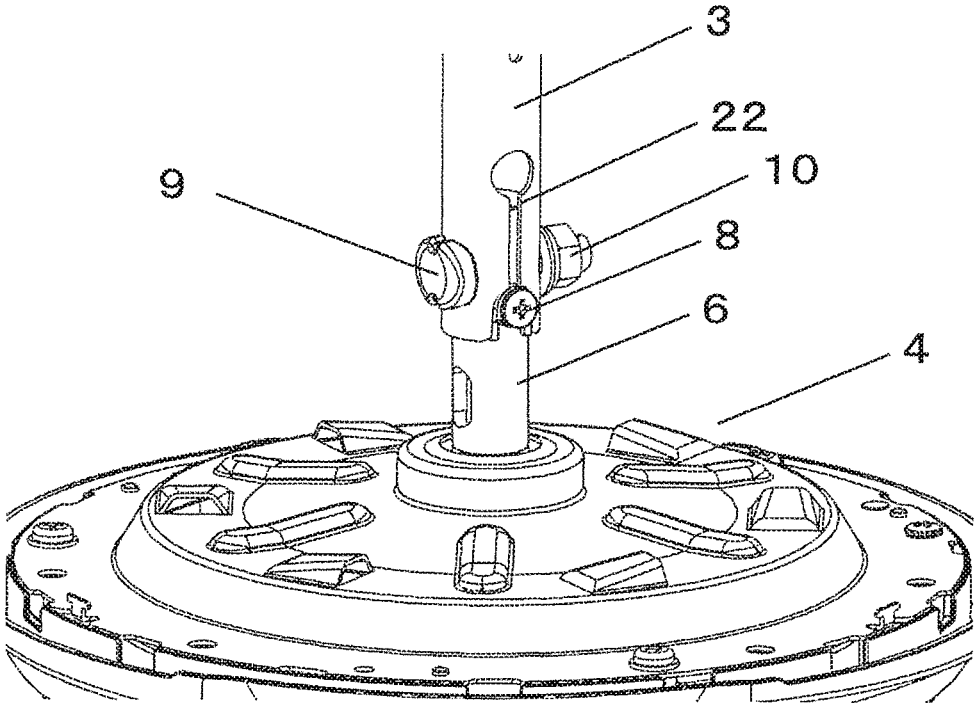
FIG. 2 is an enlarged view of the ceiling fan according to the embodiment 1.

FIG. 1 is an overall view showing the schematic constitution of a ceiling fan according to an embodiment 1 of the present invention. FIG. 2 is an enlarged view of the ceiling fan according to the embodiment 1. As shown in FIGS. 1 and 2, the ceiling fan includes: a suspender 2 which is fixed to a ceiling 1; a first pipe 3 which is suspended by the suspender 2; and a body 4 which is suspended by the first pipe 3. A plurality of blades 5 which extend in the horizontal direction are mounted on a peripheral portion of the body 4. The respective blades 5 are rotated about the center of rotation by rotating a motor (not shown in the drawing) in the inside of the body 4. An upper mounting pipe portion 6 which extends upward is mounted on an upper portion of the body 4.

Figure 3:
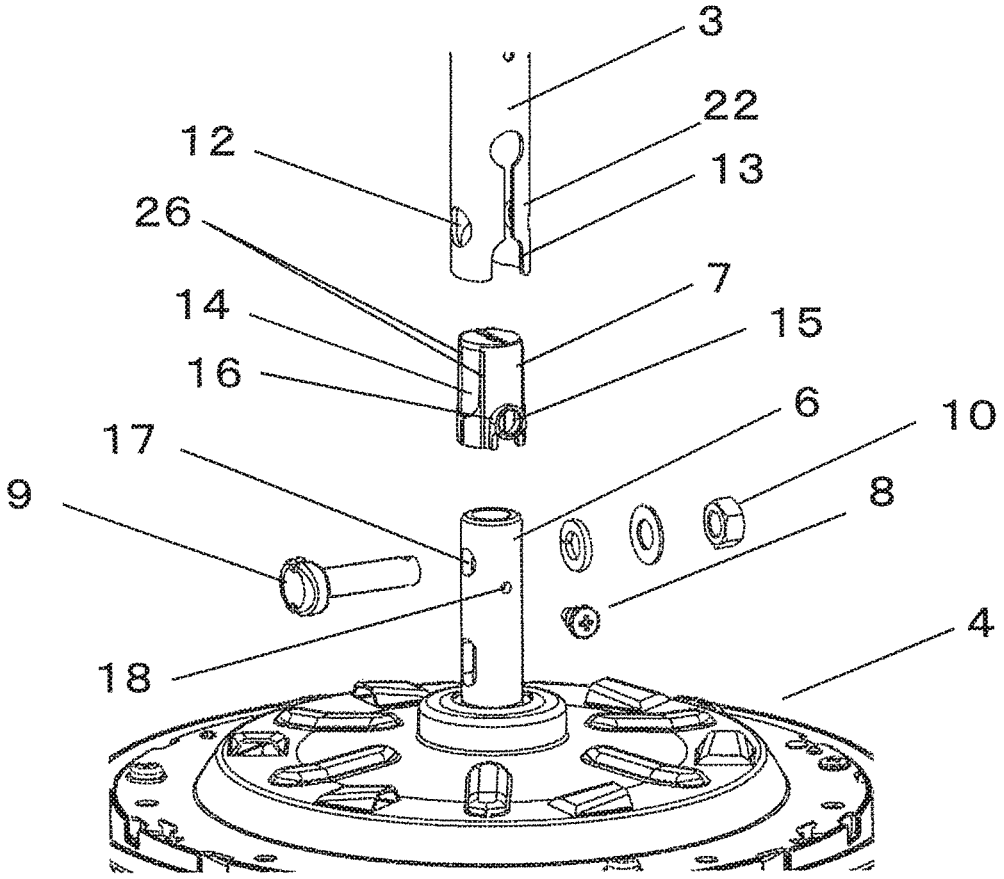
FIG. 3 is an exploded view of the ceiling fan according to the embodiment 1
Figure 4:
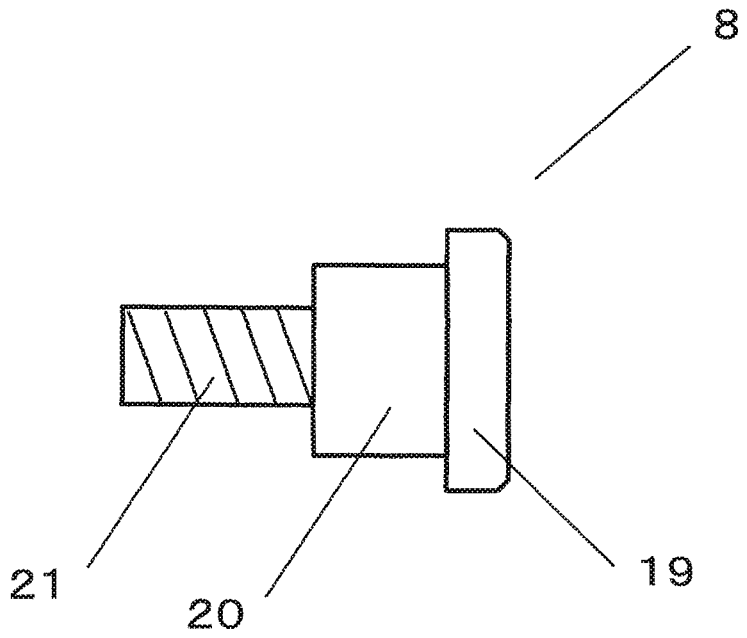
FIG. 4 is an enlarged view of a first bolt for the ceiling fan according to the embodiment 1.

FIG. 3 is an exploded view of the ceiling fan of the embodiment 1. FIG. 4 is an enlarged view of a bolt 8 used in the ceiling fan according to the embodiment 1. As shown in FIGS. 2, 3 and 4, an upper portion of a second pipe 7 is accommodated (inserted) into the inside of a lower portion of the first pipe 3, and the upper mounting pipe portion 6 is inserted into the inside of the second pipe 7. In such a state, the first pipe 3, the second pipe 7, and the upper mounting pipe portion 6 are connected to each other using the bolt 8, a connecting bolt 9, and a nut 10.

A lower portion of the first pipe 3 into which at least the second pipe 7 is accommodated is formed of a circular cylinder having the direction of a center axis thereof directed in the vertical direction, and a material of the first pipe 3 is metal, for example. A surface and an end portion of the first pipe 3 are coated with paint. As shown in FIG. 1, a suspended portion 11 which is suspended by the suspender 2 fixed to the ceiling 1 is mounted on an upper portion of the first pipe 3. First pipe holes 12 (that is, a pair of first pipe holes 12) which are formed of a circular hole which penetrate the first pipe 3 in the horizontal direction are formed in a lower outer peripheral surface of the first pipe 3. A recessed portion 13 which is an approximately semicircular notch is formed in an edge of a lower opening of the first pipe 3.

The second pipe 7 is a circular cylinder having a closed upper portion which has a center axis thereof directed in the vertical direction. A material of the second pipe 7 is a resin. For example, the second pipe 7 may be formed using polypropylene or nylon. Second pipe holes 14 (that is, a pair of second pipe holes 14) formed of an approximately elongated circular hole which penetrate the second pipe 7 in the horizontal direction are formed in an upper outer peripheral surface of the second pipe 7. A hollow projecting portion 16 having a circular cylindrical shape which projects from an outer peripheral surface of the second pipe 7 is formed on a lower outer peripheral surface of the second pipe 7. The hollow projecting portion 16 projects outwardly in the horizontal direction, for example, which is the direction intersecting with the center axis of the second pipe 7. An opening 15 is formed in the outer peripheral surface of the second pipe 7, and an inner hole of the hollow projecting portion 16 is communicated with the opening 15. That is, the hollow projecting portion 16 having a circular cylindrical shape is formed in such a manner that the hollow projecting portion 16 projects from the periphery of the opening 15 formed in the outer peripheral surface of the second pipe 7. An outer peripheral surface having a circular cylindrical shape of the hollow projecting portion 16 formed on the second pipe 7 is fitted in and is brought into contact with an inner peripheral portion of the recessed portion 13 formed on the edge of the lower opening of the first pipe 3. In the embodiment 1, the center axis of the second pipe 7 and a center axis of the hollow projecting portion 16 orthogonally intersect with each other, and the center axis direction (penetrating direction) of the second pipe holes 14 penetrating in the horizontal direction and the center axis direction of the hollow projecting portion 16 orthogonally intersect with each other as viewed from above.

The upper mounting pipe portion 6 is formed of a circular cylinder which extends upward from an upper portion of the body 4, and a center axis of the upper mounting pipe portion 6 is aligned with the center of rotation of the plurality of blades 5, for example. A material of the upper mounting pipe portion 6 is metal, for example. Upper mounting pipe holes 17 (a pair of upper mounting pipe holes 17) which are circular holes penetrating in the horizontal direction are formed on an upper outer peripheral surface of the upper mounting pipe portion 6. In an outer peripheral surface of the upper mounting pipe portion 6, an upper mounting pipe threaded hole 18 for fixing the bolt 8 is formed at a height position lower than the upper mounting pipe holes 17. In the embodiment 1, the center axis direction (penetrating direction) of the upper mounting pipe holes 17 penetrating in the horizontal direction and the center axis direction of the upper mounting pipe threaded hole 18 orthogonally intersect with each other as viewed from above.

The bolt 8 is a stepped screw, for example. The stepped screw includes: a head portion 19 having grooves used for rotating the bolt 8 with a tool; a circular columnar portion 20 extending from the head portion 19; and a screw portion 21 provided on a distal end of the circular columnar portion 20. An outer diameter of the circular columnar portion 20 is larger than a nominal diameter of a screw on the screw portion 21, and thread grooves are not formed on an outer peripheral surface of the circular columnar portion 20.

Steps of assembling the ceiling fan by connecting the first pipe 3, the second pipe 7 and the upper mounting pipe portion 6 using the bolt 8, the connecting bolt 9 and the nut 10 are explained hereinafter.

Firstly, the upper mounting pipe portion 6 is inserted into the inside of the second pipe 7 from below. Then, the bolt 8 is inserted into the inside of the hollow projecting portion 16 and the opening 15 of the second pipe 7, and the screw portion 21 of the bolt 8 is fixed into the upper mounting pipe threaded hole 18. Accordingly, an outer peripheral surface of the circular columnar portion 20 of the bolt 8 is brought into contact with an inner peripheral surface of the hollow projecting portion 16 of the second pipe. In the embodiment 1, the bolt 8 constitutes one example of a projecting portion formed on the outer peripheral surface of the upper mounting pipe portion 6.

Next, in a state where the second pipe 7 is inserted into the upper mounting pipe portion 6, the second pipe 7 is inserted into the inside of the first pipe 3 from below. Here, by inserting the second pipe 7 into the inside of the first pipe 3 in a state where the hollow projecting portion 16 of the second pipe 7 is fitted into the recessed portion 13 of the first pipe 3, the first pipe hole 12, the second pipe hole 14 and the upper mounting pipe hole 17 are communicated with each other in the horizontal direction. That is, the first pipe hole 12, the second pipe hole 14 and the upper mounting pipe hole 17 are respectively communicated with each other such that these holes penetrate portions of the first pipe 3, the second pipe 7 and the upper mounting pipe portion 6 which overlap with each other in the orthogonal direction orthogonal to the respective center axes. The connecting bolt 9 is inserted into the respective holes which are communicated with each other, and the nut 10 is mounted on a portion of the connecting bolt 9 projecting from the outer peripheral surface of the first pipe 3. Due to such steps, an inner peripheral portion of the recessed portion 13 formed on the first pipe 3 is brought into contact with the outer peripheral surface of the hollow projecting portion 16 of the second pipe 7.

One technical feature according to the embodiment 1 lies in that the outer peripheral surface of the hollow projecting portion 16 formed on the second pipe 7 is brought into contact with the inner portion of the recessed portion 13 formed on the first pipe 3 and, further, the outer peripheral surface of the bolt 8 which is fixed to the upper mounting pipe portion 6 is brought into contact with the inner peripheral surface of the hollow projecting portion 16. Due to such technical feature, with the provision of the hollow projecting portion 16 formed on the second pipe 7, among the first pipe 3, the second pipe 7 and the upper mounting pipe portion 6, it is possible to restrict the relative movement between the pipe portions at least in the rotating direction of the blades 5.

Depending on an installation site where the ceiling fan is mounted on the ceiling 1, there are some cases where a force is applied to the blades 5 due to an external load at the time of mounting the blades 5 or cleaning the blades 5 so that the blades 5 are deformed and are brought into an unstable state. When the blades 5 are brought into an unstable state, there exists a possibility that the body 4 of the ceiling fan largely swings during an operation of the ceiling fan. However, according to the ceiling fan of the embodiment 1, with respect to the first pipe 3, the second pipe 7 and the upper mounting pipe portion 6 which are connected to each other by the connecting bolt 9 and the nut 10, at least the relative movement between these members in the rotating direction is further restricted by the hollow projecting portion 16. Accordingly, even when a force which tends to swing the body 4 of the ceiling fan is generated, the relative movement between the pipe members can be suppressed and hence, rattling can be decreased whereby an abnormal wear at the connecting portion can be suppressed.

Further, by adopting the constitution where the outer peripheral surface of the hollow projecting portion 16 is brought into contact with the inner portion of the recessed portion 13 and the outer peripheral surface of the bolt 8 is brought into contact with the inner peripheral surface of the hollow projecting portion 16, the relative movement between the pipe members can be restricted also in the upward and downward directions (vertical direction), for example, in addition to the rotating direction of the blades 5. Accordingly, a connecting state between the pipe members can be strengthened.

In the embodiment 1, as an example, the case is explained where the recessed portion 13 and the outer peripheral surface of the hollow projecting portion 16 are brought into contact with each other, and the inner peripheral surface of the hollow projecting portion 16 and the outer peripheral surface of the bolt 8 are brought into contact with each other. However, the embodiment 1 is not limited to the case where the parts are brought into contact with each other in such a manner. For example, there may be a case where the outer peripheral surface of the hollow projecting portion 16 formed on the second pipe 7 is arranged close to the inner portion of the recessed portion 13 formed on the first pipe 3, and the outer peripheral surface of the bolt 8 fixed to the upper mounting pipe portion 6 is arranged close to the inner peripheral surface of the hollow projecting portion 16. Here, "arranged close to" means a case where there is a slight clearance necessary at the time of assembling exists between parts engaged with each other by fitting. "Arranged close to" means a case where a clearance exists between the members arranged close to each other to an extent that when the blades 5 are brought into an unbalanced state so that a force which generates large swinging in the body 4 of the ceiling fan is generated during the operation, the members are brought into contact with each other so that rattling between the members can be decreased. That is, even in the case where a slight clearance necessary at the time of assembling exists between the parts which are engaged with each other by fitting, when the clearance is a clearance of a size at which rattling can be suppressed by the connecting portion of the body of the ceiling fan to an extent that abnormal wear can be suppressed, such a state satisfies "arranged close to". Embodiment 1 includes a case where some of the members which are brought into contact with each other and the other of the members which are arranged close to each other exist in a mixed state among the respective members.

Further, by inserting the upper mounting pipe portion 6 into the second pipe 7, and by inserting the bolt 8 into the hollow projecting portion 16 and the opening 15 and by fixing the bolt 8 to the upper mounting pipe hole 18, it is possible to fix the second pipe 7 such that the second pipe 7 is not removed from the upper mounting pipe portion 6. Accordingly, the ceiling fan can be packaged in a package case in a state where the second pipe 7 is fixed to the upper mounting pipe portion 6 by the bolt 8 so that the second pipe 7, the upper mounting pipe portion 6 and the bolt 8 are integrally assembled to each other and hence, it is possible to prevent forgetting of mounting of the second pipe 7 on a site.

Further, the recessed portion 13 formed on the first pipe 3 is positioned at a height below the connecting bolt 9. That is, the height position where the first pipe holes 12 are formed in the first pipe 3 adopts the arrangement relationship where the first pipe holes 12 are arranged above the recessed portion 13 formed on the edge of the lower opening, and the first pipe holes 12 and the recessed portion 13 are spaced apart from each other. Due to such arrangement relationship, lowering of strengths of the first pipe holes 12 and the recessed portion 13 formed on the first pipe 3 can be suppressed.

Assuming a case where the recessed portion 13 formed on the first pipe 3 extends to a height position above the connecting bolt 9, a notched portion of the recessed portion 13 extends to a height position above the first pipe holes 12 from the edge of the lower opening formed in the first pipe 3. In such a case, a distance between the first pipe holes 12 and the notched portion of the recessed portion 13 becomes shorter than a corresponding distance in the constitution of the embodiment 1 and hence, strengths of the first pipe holes 12 and the recessed portion 13 formed on the first pipe 3 are lowered. That is, by arranging the recessed portion 13 formed on the first pipe 3 at the height position below the connecting bolt 9, it is possible to suppress lowering of strengths of the first pipe holes 12 and the recessed portion 13 formed on the first pipe 3.

In a state where the respective pipe members are connected to each other, a gap formed between the inner peripheral surface of the first pipe 3 and the outer peripheral surface of the second pipe 7 may be set smaller than a gap formed between the inner peripheral surface of the second pipe 7 and the outer peripheral surface of the upper mounting pipe portion 6.

Due to such a constitution, even when the first pipe 3 and the upper mounting pipe portion 6 tend to rotate (swing) in the directions different from each other using the connecting bolt 9 as the center of rotation, the second pipe 7 tends to rotate (swing) integrally with the first pipe 3. That is, even in a case where the inner peripheral surface of the hollow projecting portion 16 and the outer peripheral surface of the bolt 8 mounted on the upper mounting pipe portion 6 tend to slide relative to each other, the inner portion of the recessed portion 13 formed on the first pipe 3 and the outer peripheral surface of the hollow projecting portion 16 formed on the second pipe 7 are brought into contact with each other so that it is possible to suppress the relative sliding between the inner peripheral surface of the hollow projecting portion 16 and the outer peripheral surface of the bolt 8. As a result, the occurrence of wear between the recessed portion 13 formed on the first pipe 3 and the hollow projecting portion 16 formed on the second pipe 7 can be suppressed. Here, "gap" is a slight clearance which is formed between the parts which are engaged with each other by fitting and is necessary at the time of assembling. The assembling property of the ceiling fan can be enhanced by forming such a gap.

A contact area between the outer peripheral surface of the bolt 9 (an outer peripheral surface of the circular columnar portion 20) and the inner peripheral surface of the hollow projecting portion 16 formed on the second pipe 7 (contactable area in the case where the outer peripheral surface of the bolt 9 and the inner peripheral surface of the hollow projecting portion 16 are arranged close to each other) may be set larger than a contact area between the inner portion of the recessed portion 13 formed on the first pipe 3 and the outer peripheral surface of the hollow projecting portion 16 formed on the second pipe 7. Specifically, the hollow projecting portion 16 which is a circular cylinder projecting outward from the outer peripheral surface of the second pipe 7 further projects from the outer peripheral surface of the first pipe 3 in a state where the first pipe 3 and the second pipe 7 are connected to each other. Due to such a constitution, a contact length in the projecting direction between the inner peripheral surface of the hollow projecting portion 16 and the outer peripheral surface of the bolt 8 can be increased. That is, with respect to the contact between the outer peripheral surface of the bolt 8 and the hollow projecting portion 16 formed on the second pipe, a contact length of the hollow projecting portion 16 in the center axis direction of the circular cylinder is set larger than a contact length in the center axis direction between the recessed portion 13 formed on the first pipe 3 and the hollow projecting portion 16 formed on the second pipe 7.

By largely ensuring the contact length in the projecting direction between the outer peripheral surface of the bolt 8 and the inner peripheral surface of the hollow projecting portion 16 of the second pipe 7 in this manner, a wear which occurs between the outer peripheral surface of the bolt 8 and the hollow projecting portion 16 of the second pipe 7 can be suppressed.

Particularly, by largely ensuring the contact length in the projecting direction between the outer peripheral surface of the bolt 8 and the inner peripheral surface of the hollow projecting portion 16 of the second pipe 7 while decreasing a gap formed between the inner peripheral surface of the first pipe 3 and the outer peripheral surface of the second pipe 7, a connection state between the respective pipe members can be further strengthened.

Further, a first slot portion 22 may be formed in the first pipe 3 such that the first slot portion 22 extends upward from an inner portion of the recessed portion 13 formed on the edge of the lower opening of the first pipe 3. The first slot portion 22 is a longitudinally elongated groove-like hole where a width size of the first slot portion 22 in the horizontal direction is smaller than a length of the first slot portion 22 in the vertical direction. The first slot portion 22 extends upward to a height position above the connecting bolt 9 from the center of an upper portion of the recessed portion 13, specifically, an upper edge of an approximately semicircular notch which constitutes the recessed portion 13 between two first pipe holes 12 as circular holes penetrating the first pipe 3 in the horizontal direction. A width size of the first slot portion 22 is set smaller than a width size of the recessed portion 13 formed on the first pipe 3 in the horizon direction.

In this manner, by forming the first slot portion 22 in the first pipe 3, the slight clearance which is necessary at the time of assembling between the recessed portion 13 of the first pipe 3 and the hollow projecting portion 16 of the second pipe 7 can be decreased after assembling. Specifically, in connecting the first pipe 3, the second pipe 7 and the upper mounting pipe portion 6 to each other, when the connecting bolt 9 and the nut 10 are fastened to each other, a width size of the first slot portion 22 of the first pipe 3 is decreased. Accordingly, at the approximately semicircular notched portion which constitutes the recessed portion 13, a distance between opposite ends of the notched portion in the axial direction of the connecting bolt 9 is decreased. As a result, the clearance between an inner portion of the recessed portion 13 of the first pipe 3 and an outer peripheral surface of the hollow projecting portion 16 of the second pipe 7 can be decreased.

At the same time, by decreasing a width size of the first slot portion 22 by fastening the connecting bolt 9 at the time of connecting the first pipe 3, the second pipe 7 and the upper mounting pipe portion 6, an inner diameter of the first pipe 3 can be decreased and hence, a gap formed between the inner peripheral surface of the first pipe 3 and the outer peripheral surface of the second pipe 7 can be decreased.

Further, a second slot portion (not shown in the drawing) may be formed in the first pipe 3 such that the second slot portion is arranged opposite to the first slot portion 22. The second slot portion may have the same shape and the same size as the first slot portion 22. The second slot portion is arranged opposite to the first slot portion 22 of the first pipe 3, and extends upward to a height position above the connecting bolt 9 from an edge of a lower opening of the first pipe 3 between two first pipe holes 12 as circular holes penetrating the first pipe 3 in the horizontal direction. A height position of an upper end of the second slot portion and a width size of the second slot portion may be set equal to the height position of the upper end of the second slot portion and the width size of the second slot portion, respectively.

Due to such a constitution, by fastening the connecting bolt 9 and the nut 10 to each other at the time of connecting the first pipe 3, the second pipe 7 and the upper mounting pipe portion 6, width sizes of the first slot portion 22 and the second slot portion of the first pipe 3 can be easily decreased. Accordingly, at the approximately semicircular notched portion which constitutes the recessed portion 13, a distance between the end portions of the notched portion in the axial direction of the connecting bolt 9 is easily decreased. As a result, the clearance between an inner portion of the recessed portion 13 of the first pipe 3 and an outer peripheral surface of the hollow projecting portion 16 of the second pipe 7 can be decreased.

Ribs 26 may be formed on the outer peripheral surface of the second pipe 7 such that the ribs 26 project outward from the outer peripheral surface of the second pipe 7. A material of the ribs 26 may be nylon, for example. The ribs 26 are projections which project outward from the outer peripheral surface of the second pipe 7 and extend in the vertical direction. The ribs 26 extend in the vertical direction at the opening edge of the second pipe hole 14 of the second pipe 7 and form a part of the opening edge. Due to such a constitution, strength of the second pipe 7 itself can be enhanced. When the second pipe 7 is inserted into the inside of the first pipe 3 in a state where the second pipe 7 is inserted into the inside of the upper mounting pipe portion 6, the second pipe 7 is inserted into the inside of the first pipe 3 in a state where distal ends (distal ends in the projecting direction) are brought into contact with the inner peripheral surface of the first pipe 3 and collapse. Accordingly, there exists substantially no clearance between the inner peripheral surface of the first pipe 3 and the distal ends of the ribs 26 which constitutes an outer peripheral portion of the second pipe 7. The ribs 26 are formed using nylon and hence, when the blades 5 are brought into an unbalanced state and a force which tends to largely swing the body 4 of the ceiling fan during the operation of the ceiling fan is generated, it is possible to suppress a further collapse of the ribs 26.

Assuming a case where the ribs 26 are formed using polypropylene, although the second pipe 7 can be inserted into the inside of the first pipe 3 while causing a collapse of the distal ends of the ribs 26, when the blades 5 are brought into an unbalanced state and a force which tends to largely swing the body 4 of the ceiling fan during the operation of the ceiling fan is generated, the ribs 26 more easily collapse than nylon and may cause rattling. On the other hand, assuming a case where the ribs 26 are formed using a material harder than nylon, in inserting the second pipe 7 into the first pipe 3, the distal ends of the ribs 26 hardly collapse and hence, it is difficult to insert the second pipe 7 into the first pipe 3. As a result, by forming the ribs 26 using nylon, particularly, nylon 66 (registered trademark), the gap between the first pipe 3 and the second pipe 7 can be decreased and, at the same time, the rattling can be suppressed. The whole second pipe 7 including the ribs 26 may be formed using nylon.

Embodiment 2

Figure 5:
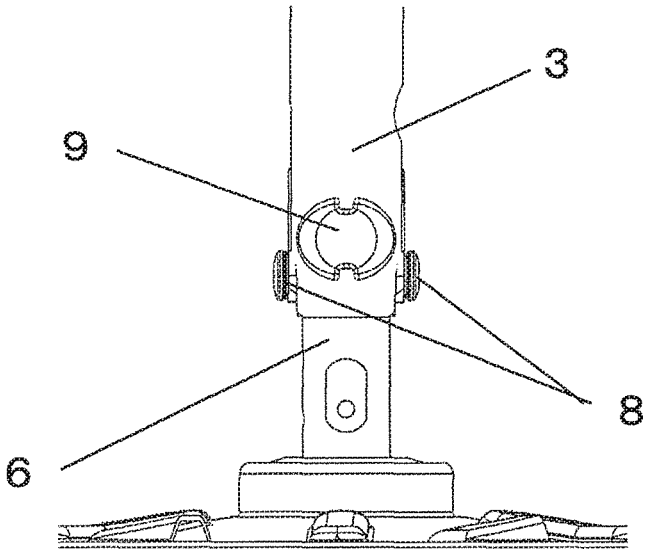
FIG. 5 is an enlarged view of a ceiling fan according to an embodiment 2.
Figure 6:
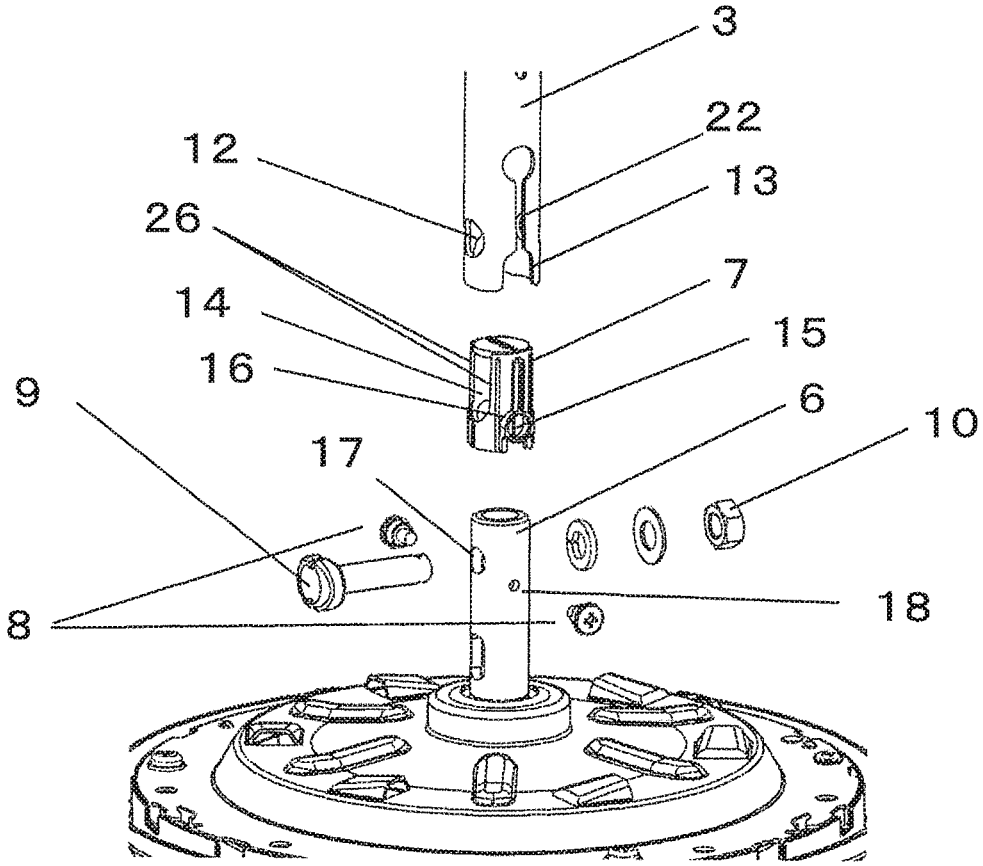
FIG. 6 is an exploded view of the ceiling fan according to the embodiment 2.

Next, a ceiling fan according to an embodiment 2 of the present invention is explained. FIG. 5 is an enlarged view of the ceiling fan according to the embodiment 2, and FIG. 6 is an exploded view of the ceiling fan according to the embodiment 2. In FIGS. 5 and 6, constitutional elements identical with the corresponding constitutional elements in FIGS. 2 and 3 are given the same reference numerals, and the detailed explanation of such constitutional elements is omitted.

As shown in FIGS. 5 and 6, the recessed portion 13 of the first pipe 3, the hollow projecting portion 16 of the second pipe 7, the upper mounting pipe threaded hole 18 of the upper mounting pipe portion 6, and the bolt 8 are provided in two sets such that the respective corresponding members face each other in an opposed manner. By providing the constitution which restricts the relative movement between the respective pipe members using the hollow projecting portion 16 in two sets, rattling of the ceiling fan can be further decreased thus suppressing an abnormal wear at the connecting portion.

Embodiment 3

Figure 7:
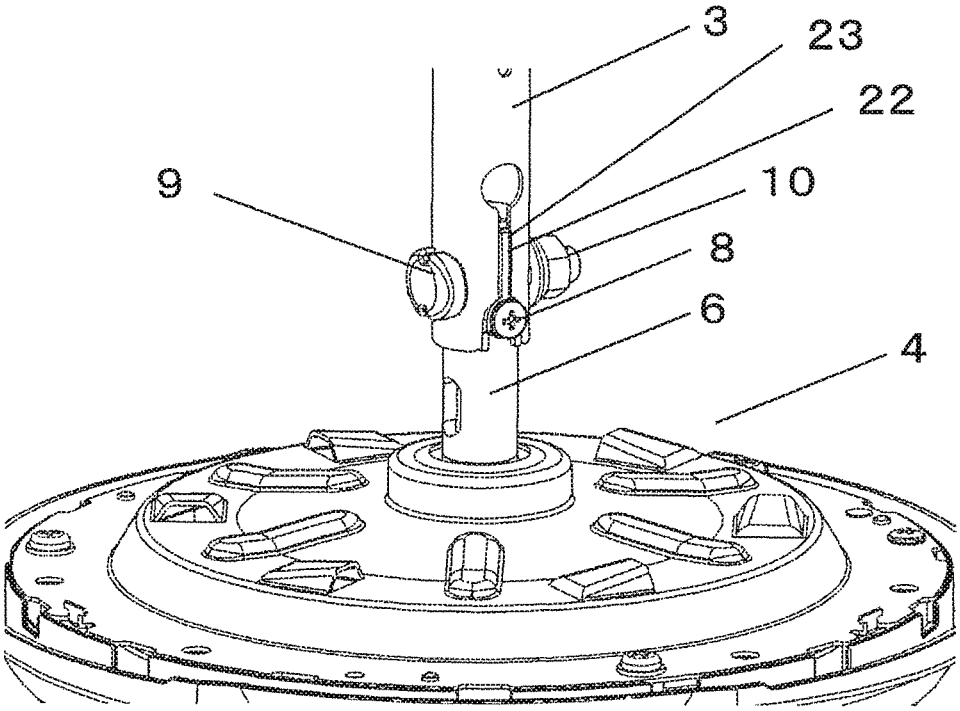
FIG. 7 is an enlarged view of a ceiling fan according to an embodiment 3 of the present invention.
Figure 8:
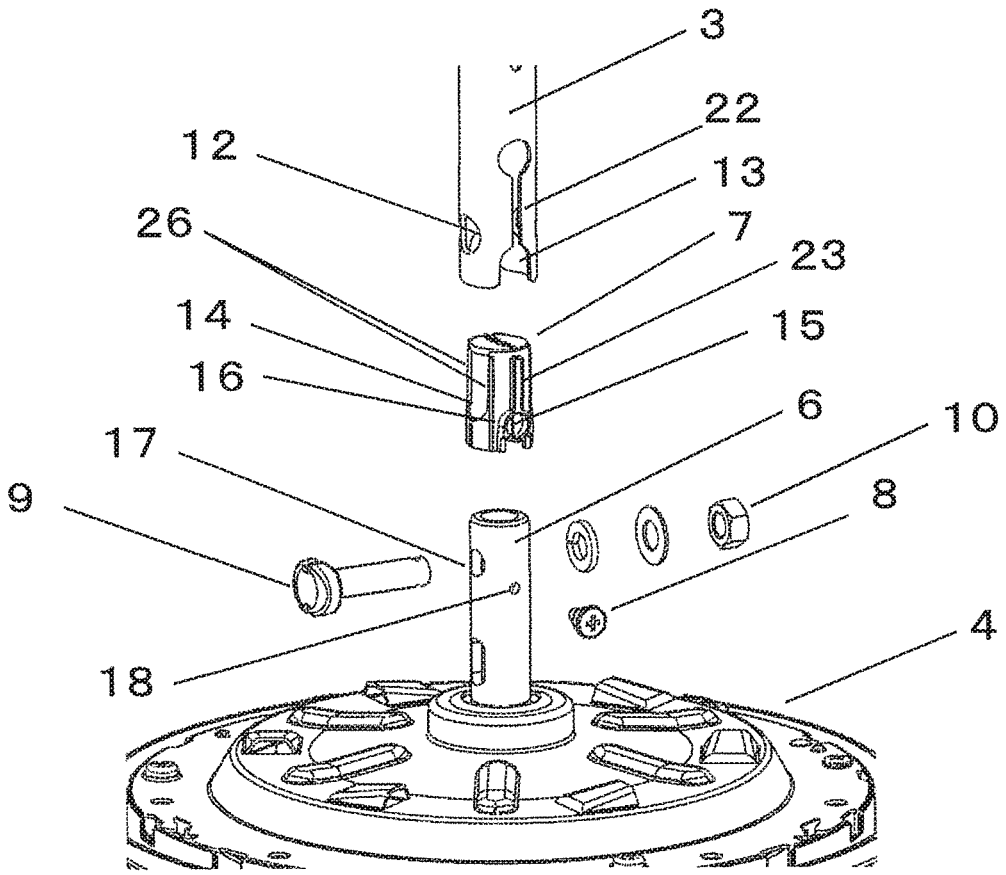
FIG. 8 is an exploded view of the ceiling fan according to the embodiment 3.

Next, a ceiling fan according to an embodiment 3 of the present invention is explained. FIG. 7 is an enlarged view of the ceiling fan according to the embodiment 3, and FIG. 8 is an exploded view of the ceiling fan according to the embodiment 3. In FIGS. 7 and 8, constitutional elements identical with the corresponding constitutional elements in FIGS. 2 and 3 are given the same reference numerals, and the detailed explanation of such constitutional elements is omitted.

As shown in FIGS. 7 and 8, an upper projecting portion 23 is formed on an outer peripheral surface of the second pipe 7 such that the upper projecting portion 23 extends upward from an upper portion of the hollow projecting portion 16 and is fitted on an inner side of the first slot portion 22. The upper projecting portion 23 extends upward from an upper end portion of the hollow projecting portion 16, and has a shape where a width size of the upper projecting portion 23 in the horizontal direction is smaller than a length size of the upper projecting portion 23 in the vertical direction. The upper projecting portion 23 is integrally formed with the second pipe 7. The width size of the upper projecting portion 23 and the width size of the first slot portion 22 are set such that both portions are brought into contact with each other or a slight clearance exists between both portions in a state where the upper projecting portion 23 is positioned inside the first slot portion 22.

Due to such a constitution, in a state where the hollow projecting portion 16 of the second pipe 7 is brought into contact with or is arranged closed to the recessed portion 13 of the first pipe 3 and, at the same time, the outer peripheral surface of the bolt 8 of the upper mounting pipe portion 6 is brought into contact with or is arranged close to the inner peripheral surface of the hollow projecting portion 16, the upper projecting portion 23 of the second pipe 7 is further brought into contact with or is arranged close to the inner portion of the first slot portion 22 of the first pipe 3. That is, by bringing the upper projecting portion 23 of the second pipe 7 into contact with the inner portion of the first slot portion 22 of the first pipe 3 or by arranging the upper projecting portion 23 of the second pipe 7 close to the inner portion of the first slot portion 22 of the first pipe 3, it is possible to further restrict the relative movement between the first pipe 3 and the second pipe 7 in the rotating direction of the blades 5. Accordingly, even when the blades 5 are brought into an unbalanced state and a force which tends to largely swing the body of the ceiling fan is generated during the operation of the ceiling fan, rattling between the respective pipe members can be decreased whereby an abnormal wear at the connecting portion can be suppressed.

The recessed portion 13 and the first slot portion 22 of the first pipe 3, the hollow projecting portion 16, the upper projecting portion 23 and the bolt 8 may be provided in two sets such that the corresponding members of the respective sets face each other. Due to such a constitution, rattling of the ceiling fan can be further decreased and hence, an abnormal wear at the connecting portion can be suppressed.

Embodiment 4

Figure 9:
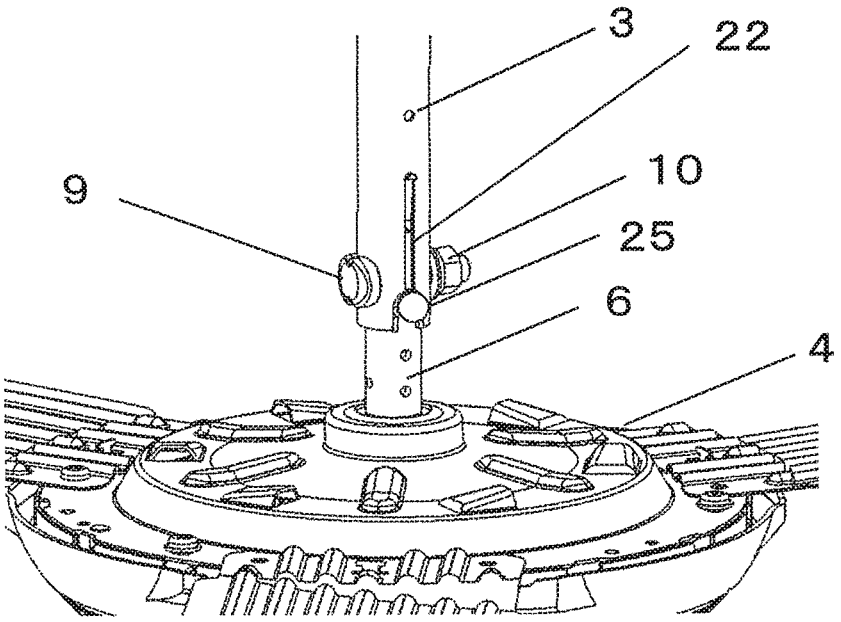
FIG. 9 is an enlarged view of a ceiling fan according to an embodiment 4 of the present invention.
Figure 10:
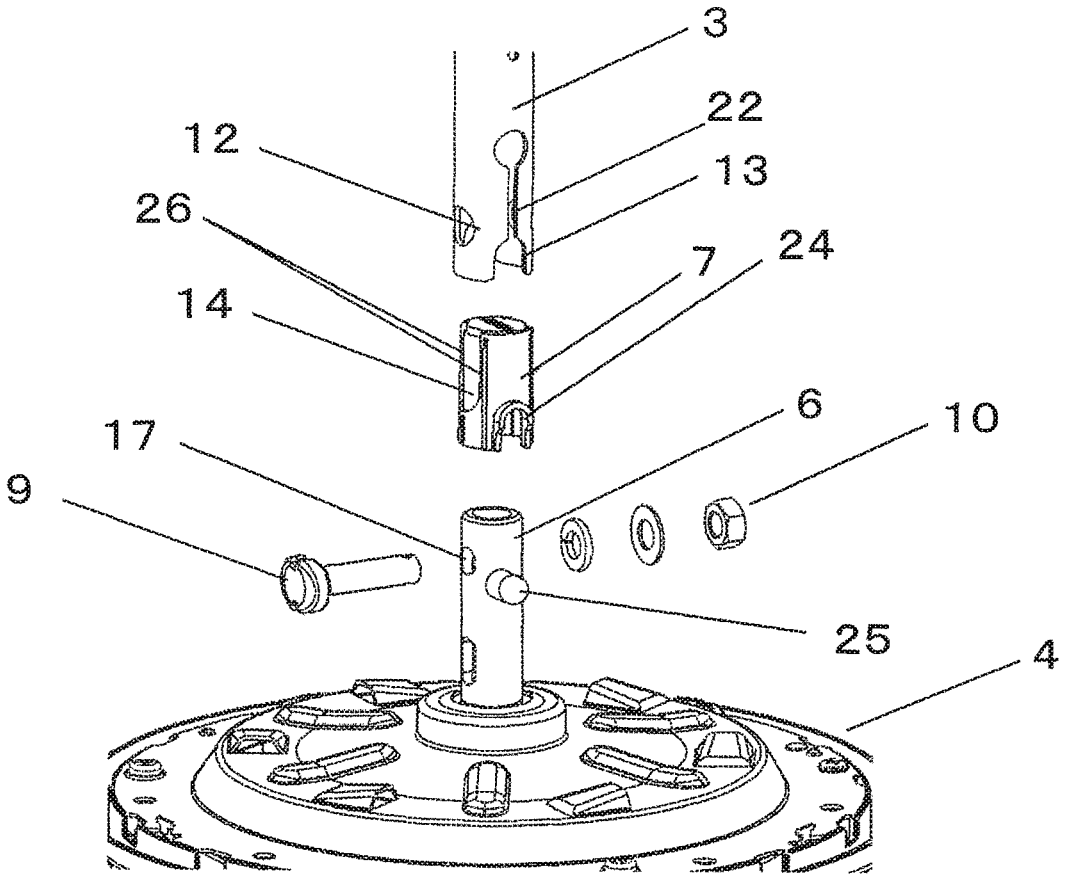
FIG. 10 is an exploded view of the ceiling fan according to the embodiment 4.

Next, a ceiling fan according to an embodiment 4 of the present invention is explained. FIG. 9 is an enlarged view of the ceiling fan according to the embodiment 4, and FIG. 10 is an exploded view of the ceiling fan according to the embodiment 4. In FIGS. 9 and 10, constitutional elements identical with the corresponding constitutional elements in FIGS. 2 and 3 are given the same reference numerals, and the detailed explanation of such constitutional elements is omitted.

As shown in FIGS. 9 and 10, a recessed portion 13 is formed on an edge of a lower opening of a first pipe 3. A hollow projecting portion 24 which is fitted into the recessed portion 13 is formed on an edge of a lower opening of a second pipe 7. A protruding portion 25 which is fitted into the hollow projecting portion 24 of the second pipe 7 is formed on an upper mounting pipe portion 6.

The hollow projecting portion 24 formed on the edge of the lower opening of the second pipe 7 has a partial cylindrical shape which projects outward from an outer peripheral surface of the second pipe 7. Specifically, an upper portion of the hollow projecting portion 24 has a semicircular cylindrical shape, and a lower portion of the hollow projecting portion 24 is formed of a notched portion which opens toward the edge of the lower opening of the second pipe 7. A center axis of the hollow projecting portion 24 and a center axis of a second pipe hole portion 14 which penetrates in the horizontal direction are orthogonal to each other as viewed from above.

An upper mounting pipe holes 17 as circular holes which penetrate in the horizontal direction are formed in an upper portion of an outer peripheral surface of the upper mounting pipe portion 6, and a protruding portion 25 is formed on a lower portion of an outer peripheral surface of the upper mounting pipe portion 6.

The protruding portion 25 has a circular columnar shape which projects outward in the horizontal direction from the outer peripheral surface of the upper mounting pipe portion 6. The protruding direction (center axis direction) of the protruding portion 25 is orthogonal to the center axis direction of the upper mounting pipe holes 17 penetrating in the horizontal direction as viewed from above. It is sufficient that the protruding portion 25 is fixed to the upper mounting pipe portion 6. That is, the protruding portion 25 may be integrally formed with the upper mounting pipe portion 6 or may be formed as a member separate from the upper mounting pipe portion 6.

Steps of assembling the ceiling fan having such a constitution by connecting the first pipe 3, the second pipe 7 and the upper mounting pipe portion 6 using a connecting bolt 9 and a nut 10.

Firstly, in a state where the second pipe 7 is inserted into the inside of the first pipe 3 from below, the upper mounting pipe portion 6 is inserted into the inside of the second pipe 7 from below. Next, at a portion where the first pipe 3, the second pipe 7 and the upper mounting pipe portion 6 overlap with each other, the connecting bolt 9 is inserted into these members in a penetrating manner through the respective holes 12, 14, 17, and the nut 10 is threadedly mounted on a portion of the connecting bolt 9 projecting from the first pipe 3.

Due to such a constitution, an inner portion of the recessed portion 13 of the first pipe 3 is brought into contact with or is arranged close to an outer peripheral surface of the semi-cylindrical hollow projecting portion 24 of the second pipe 7. Further, an outer peripheral surface of the protruding portion 25 of the upper mounting pipe portion 6 is brought into contact with or is arranged close to an inner peripheral surface of the hollow projecting portion 24 of the second pipe 7.

Accordingly, even when the blades 5 are brought into an unbalanced state so that a force which tends to largely swing a body of the ceiling fan is generated during the operation of the ceiling fan, at least the relative movement among the first pipe 3, the second pipe, and the upper mounting pipe portion 6 in the rotating direction of the blades 5 can be restricted also by the semi-cylindrical hollow projecting portion 24, in addition to the connection using the connecting bolt 9 and the nut 10. Accordingly, rattling between the respective pipe members can be decreased and hence, an abnormal wear at the connecting portion can be suppressed.

In the above-mentioned explanation of the embodiments, the explanation has been made with respect to the case, for example, where the first slot portion 22 which extends upward from the upper end portion of the recessed portion 13 is formed on the first pipe 3 as shown in FIG. 2. However, the present invention is not limited to such a case. For example, the present invention is also applicable to a case where only the recessed portion 13 is formed on the first pipe 3 without forming the first slot portion 22 in the first pipe 3.

Further, in the embodiment shown in FIG. 2, a circular hole is formed in the first pipe 3 such that the circular hole is connected with an upper end of the first slot portion 22. However, the present invention is applicable to the case where such a circular hole is not formed. When such a circular hole is formed, by arranging the circular hole in a spaced-apart manner from the first pipe hole 12, lowering of strength of the first pipe hole 12 can be suppressed.

In the above-mentioned embodiments, the case where the hollow projecting portion has a circular cylindrical shape or a semi-circular cylindrical shape has been exemplified. However, the hollow projecting portion is not limited to such a shape. For example, the hollow projecting portion may have an elliptical cylindrical shape, a partial circular cylindrical shape having a circumference smaller than the semi-circular cylindrical shape or a partial circular cylindrical shape having a circumference larger than the semi-circular cylindrical shape.

Further, the recessed portion 13 formed on the edge of the lower opening of the first pipe 3 is not limited to the recessed portion which is formed as an approximately semi-circular notch. It is sufficient for the recessed portion 13 that a portion of the recessed portion 13 which is brought into contact with or is arranged close to the outer peripheral portion of the hollow projecting portion has a shape which conforms to an outer peripheral shape of the hollow projecting portion and hence, the recessed portion 13 can take various configurations in conformity with the shape of the hollow projecting portion.

By suitably combining desired embodiments out of the above-mentioned various embodiments, it is possible to acquire advantages which the respective embodiments possess.

INDUSTRIAL APPLICABILITY

The ceiling fan according to the present invention can suppress an abnormal wear at the connecting portion of the pipe bodies which suspend the body of the ceiling fan, and is expected to be used usefully as a ceiling fan at home, office or the like.

DESCRIPTION OF REFERENCE SIGNS

1: ceiling
2: suspender
3: first pipe
4: body
5: blade
6: upper mounting pipe portion
7: second pipe
8: bolt
9: connecting bolt
10: nut
11: suspended portion
12: first pipe hole
13: recessed portion
14: second pipe hole
15: opening
16: hollow projecting portion (circular cylindrical shape)
17: upper mounting pipe hole
18: upper mounting pipe threaded hole
19: head portion
20: circular columnar portion
21: threaded portion
22: first slot portion
23: upper projecting portion
24: hollow projecting portion (semicircular cylindrical shape)
25: projecting portion
26: rib

The invention claimed is:

1. A ceiling fan comprising:

a body having a plurality of blades which are rotatable about a center of rotation, and an upper mounting pipe portion which extends upward along the center of rotation as a center axis thereof;

a suspender configured to be fixed to a ceiling;

a first pipe which is suspended from the suspender along the center of rotation of the plurality of blades as a center axis thereof, and suspends the body by the upper mounting pipe portion; and a second pipe which is accommodated in an inside of a lower portion of the first pipe and into which an upper portion of the upper mounting pipe portion is inserted, wherein the first pipe, the second pipe and the upper mounting pipe portion are connected to each other by a connecting bolt and a nut, the connecting bolt penetrating an overlapping part where the first pipe, the second pipe and the upper mounting pipe portion overlap with each other in the direction intersecting with the center axis, the nut being threadedly engaged with the connecting bolt, the second pipe has a hollow projecting portion having a cylindrical shape or a partial cylindrical shape which projects from an outer peripheral surface of the second pipe in the direction intersecting with the center axis, a recessed portion which is brought into contact with or is arranged close to an outer peripheral surface of the hollow projecting portion of the second pipe is provided on an edge of a lower opening of the first pipe, a protruding portion which is brought into contact with or is arranged close to an inner peripheral surface of the hollow projecting portion of the second pipe is provided on an outer peripheral surface of the upper mounting pipe portion, and at least the relative movement among the first pipe, the second pipe, and the upper mounting pipe portion in the rotating direction of the plurality of blades is restricted by the hollow projecting portion of the second pipe.

2. The ceiling fan according to claim 1, wherein a first slot which extends upward from the recessed portion is provided on the first pipe.

3. The ceiling fan according to claim 2, wherein an upper projecting portion which extends upward from an upper portion of the hollow projecting portion and is positioned inside the first slot formed in the first pipe is further provided on the second pipe, and at least the relative movement between the first pipe and the second pipe in the rotating direction of the plurality of blades is restricted by the upper projecting portion of the second pipe.

4. The ceiling fan according to claim 1, wherein a rib which projects outward from the outer peripheral surface of the second pipe is provided on the second pipe, a distal end of the rib is brought into contact with an inner peripheral surface of the first pipe, and a material of the second pipe is nylon.

5. The ceiling fan according to claim 1, wherein the recessed portion provided on the first pipe is positioned at a height position below the connecting bolt.

6. The ceiling fan according to claim 1, wherein a gap between the first pipe and the second pipe is smaller than a gap between the second pipe and the upper mounting pipe portion.

7. The ceiling fan according to claim 1, wherein a contact length between the inner peripheral surface of the hollow projecting portion of the second pipe and the projecting portion of the upper mounting pipe portion is larger than a contact length between the outer peripheral surface of the hollow projecting portion and the recessed portion of the first pipe, in the projecting direction of the hollow projecting portion.

8. The ceiling fan according to claim 1, wherein a bolt is mounted on the outer peripheral surface of the upper mounting pipe portion, and an outer peripheral surface of the bolt is brought into contact with or is arranged close to the inner peripheral surface of the hollow projecting portion of the second pipe.

* * * * *